US005653787A

United States Patent [19]

Poirier

[11] Patent Number: 5,653,787

[45] Date of Patent: Aug. 5, 1997

[54] DISTILLATE FUEL COMPOSITION CONTAINING COMBINATION OF SILVER CORROSION INHIBITORS

[75] Inventor: Marc-Andre Poirier, Sarnia, Canada

[73] Assignee: Exxon Research & Engineering Company, Florham Park, N.J.

[21] Appl. No.: 471,210

[22] Filed: Jun. 6, 1995

Related U.S. Application Data

[63] Continuation-in-part of Ser. No. 253,660, Jun. 3, 1994, abandoned, which is a continuation-in-part of Ser. No. 40,246, Mar. 30, 1993, abandoned.

[51] Int. Cl.[6] ..... C10L 1/22; C10L 1/24

[52] U.S. Cl. ..... 44/341

[58] Field of Search ..... 44/342, 343, 341

[56] References Cited

U.S. PATENT DOCUMENTS 3,663,561 5/1972 Blaha ..... 44/341

5,035,720 7/1991 Weers ..... 44/343

*Primary Examiner*—Prince Willis, Jr.
*Assistant Examiner*—Cephia D. Toomer
*Attorney, Agent, or Firm*—James H. Takemoto; Joseph J. Allocca

[57] ABSTRACT

A distillate fuel composition for reducing silver corrosion in two-cycle internal combustion engines which comprises motor gasoline, a lubricating oil basestock and a combination of a 2,5-dihydrocarbyldithio-1,3,4-thiadiazole of the formula

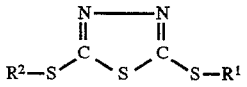

wherein $R^1$ and $R^2$ are independently $R^3S$ or H where $R^3$ is a hydrocarbyl group containing from 1 to 16 carbon atoms with the proviso that at least one of $R^1$ and $R^2$ is not hydrogen, and an adduct of benzotriazole or tolyltriazole and an alkoxyamine.

9 Claims, No Drawings

DISTILLATE FUEL COMPOSITION CONTAINING COMBINATION OF SILVER CORROSION INHIBITORS

This application is a continuation-in-part of U.S. Ser. No. 253,660 filed Jun. 3, 1994, abandoned, which is a continuation-in-part of U.S. Ser. No. 040,246 filed Mar. 30, 1993, now abandoned.

BACKGROUND OF THE INVENTION

1. Field of the Invention

This invention relates to a distillate fuel composition containing a thiadiazole and a tolyltriazole adduct as copper and silver corrosion inhibitors, and its use to reduce copper and silver corrosion in fuel delivery systems and internal combustion engines.

2. Description of the Related Art

It is well known that elemental sulfur, hydrogen sulfide and other sulfur compounds, contained in hydrocarbon streams are corrosive and damaging to metal equipment, particularly copper and copper alloys. Sulfur and sulfur compounds may be present in varying concentrations in the refined fuel and additional contamination may take place as a consequence of transporting the refined fuel through pipelines containing sulfur contaminants. Sulfur has a particularly corrosive effect on equipment such as brass valves, gauges and in-tank fuel pump copper commutators.

A commonly used technique for inhibiting corrosion of copper, steel or copper alloys in fuel systems is by the use of corrosion inhibitors. These additives are either sulfur scavengers or metal deactivators that coat metal surfaces preventing sulfur components to react with the metal. Many such corrosion inhibitors are known. For example, U.S. Pat. No. 3,663,561 discloses 2-hydrocarbylthio-5-mercapto-1,3,4-thiadiazoles which are stated to be useful as sulfur scavengers and U.S. Pat. No. 5,035,720 relates to a corrosion inhibiting composition comprising an oil-soluble adduct of a triazole and a basic nitrogen compound.

It would be desirable to have a copper and silver corrosion inhibitor which would protect copper and silver at low treat rates when exposed to a variety of fuels under different conditions, which would not produce high levels of insolubles or cause injector sticking in diesel engines, and which would inhibit silver corrosion in two-cycle engines.

SUMMARY OF THE INVENTION

This invention relates to a distillate fuel composition having improved copper corrosion properties which comprises a major amount of middle distillate fuel containing corrosive sulfur and a synergistic additive combination of (a) from 2 to 50 ppmw of at least one 2,5-dihydrocarbyldithio-1,3,4-thiadiazole of the formula

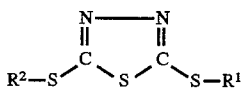

where $R^1$ and $R^2$ are independently hydrogen or $R^3S$ where $R^3$ is a hydrocarbyl group containing 1 to 16 carbon atoms with the proviso that at least one of $R^1$ and $R^2$ is not hydrogen, and (b) from 5 to 90 ppmw of an adduct of benzotriazole or tolyltriazole and an alkoxyamine.

In another embodiment, this invention concerns a method for reducing copper corrosion in a fuel delivery system or internal combustion engine by operating the fuel delivery system or internal combustion engine with the composition described above. Yet another embodiment involves a fuel additive concentrate containing the above additive combination.

This invention also relates to a distillate fuel composition for two-cycle engines having improved silver corrosion properties which comprises a major amount of distillate fuel boiling in motor gasoline range containing corrosive sulfur, a minor amount of lubricating oil basestock and a synergistic additive combination of (a) from 5 to 400 mg/L of at least one 2,5-dihydrocarbyldithio-1,3,4-thiadiazole of the formula

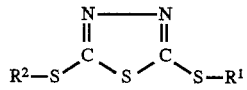

where $R^1$ and $R^2$ are independently hydrogen or $R^3S$ where $R^3$ is a hydrocarbyl group containing 1 to 16 carbon atoms with the proviso that at least one of $R^1$ and $R^2$ is not hydrogen, and (b) from 20 to 1500 mg/L of an adduct of benzotriazole or tolyltriazole and an alkoxyamine.

Another embodiment relates to a method for reducing silver corrosion in a two-cycle internal combustion engine which comprises operating the engine with the fuel composition for two-cycle engines described above.

DETAILED DESCRIPTION OF THE INVENTION

This invention concerns the discovery that a distillate fuel containing a major amount of distillate fuel and a minor amount of a synergistic combination of (a) 2,5-hydrocarbyldithio-1,3,4-thiadiazole and (b) an adduct of benzotriazole or tolyltriazole and alkoxyamine can reduce copper and silver corrosion in fuel delivery systems and internal combustion engines. The combination of components (a) and (b) unexpectedly provides better protection from copper corrosion than either of the components alone. The distillate fuels are middle distillate fuels containing corrosive sulfur. Middle distillate fuels are those having a boiling range from 175° to 350° C. Examples include diesel fuel and kerosene. Distillate fuels also include fuels having a boiling range in the motor range of from 4° to 225° C., e.g., motor gasoline as defined by ASTM D-439-73.

In the additive combination noted above, component (a) is a thiadiazole of the formula

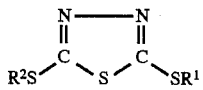

where $R^1$ and $R^2$ are hydrogen or $R^3S$, $R^3$ is preferably a $C_1$ to $C_{12}$ hydrocarbyl group. The hydrocarbyl groups include aliphatic (alkyl or alkenyl) and alicylic groups which may be substituted with hydroxy, amino, nitro and the like. Examples of preferred $R^3$ groups include methyl, ethyl, n- and iso-propyl, n-, sec- and tert-butyl, hexyl, cyclohexyl, octyl, decyl and dodecyl. Commercial products are typically mixtures of mono-substituted thiadiazoles wherein $R^1$ is H and $R^2$ is $R^3S$ and di-substituted thiadiazoles wherein $R^1$ and $R^2$ are both $R^3S$.

Preferred triazole adducts include the 1:1 adducts of benzotriazole and tolyltriazole with alkoxy fatty amines, especially adducts of tolyltriazole with alkoxy fatty amines.

Especially preferred alkoxy fatty amines have the formula $R^4R^5NR^6$ where $R^4$ and $R^5$ are $C_1$ to $C_4$ hydrocarbyl groups substituted with hydroxy, particularly $C_2$ alkyl substituted with hydroxy and $R^6$ is a $C_8$ to $C_{20}$ hydrocarbyl group, especially $C_{12}$ to $C_{18}$ alkyl or alkenyl. Examples of preferred adducts include the 1:1 adduct between tolyltriazole and bis(2-hydroxyethyl) oleylamine and between tolyltriazole and bis (2-hydroxyethyl) cocoamine.

The benzotriazole and tolyltriazole adducts with alkoxyamines may be prepared by the methods described in U.S. Pat. No. 5,035,720. In general, the amine is heated to between 70° C. and 100° C. and triazole added slowly to the heated amine with stirring. The triazole is added to amine in an approximate 1:1 mole ratio. Upon completion of the reaction, the reaction mixture is cooled and may be used without further purification.

The middle distillate fuels of this invention will, in general, comprise a major amount of distillate fuel and a minor synergistic amount of the thiadiazole and the triazole adduct. However, the precise amount and ratio of the thiadiazole and triazole adduct can vary broadly. As such, only an amount effective or sufficient to reduce copper corrosion need be used. Typically, however, the amount of the thiadiazole component will range from about 2 to about 50 ppmw, although greater amounts could be used. Preferably, from about 2 to about 30 ppmw of the thiadiazole component will be present in the fuel. The amount of benzotriazole or tolyltriazole adduct will generally range from about 5 to about 90 ppmw, preferably from about 8 to about 40 ppmw, based on fuel, although greater amounts could be used.

The distillate fuels compositions of this invention for two-cycle engines having a distillate fuel boiling in the motor gasoline range comprises a major amount of distillate fuel, a minor amount of lubricant oil basestock and a minor amount of 2,5-dihydrocarbyldithio-1,3,4-thiadiazole plus benzotriazole or tolyltriazole adduct. The lubricant oil basestocks are well known in the art and can be derived from natural lubricating oils, synthetic lubricating oils or mixtures thereof. In general, the lubricating oil basestock may have a kinematic viscosity of from about 1 to about 1000 cSt at 40° C. The ratio of fuel to oil is from 500:1 to 10:1, preferably 150:1 to 20:1. The amount of 2,5-dihydrocarbyldithio-1,3,4-thiadiazole is preferably from 50 to 300 mg/L and the amount of benzotriazole or tolyltriazole adduct with an alkoxyamine is preferably from 200 to 800 mg/L.

Other additives may be included in the fuel. Examples of such additives include antiknock agents (e.g., tetraethyl lead), detergents or dispersants, demulsifiers, antioxidants and the like.

Although the benzotriazole or tolyltriazole adducts and thiadiazoles used herein will generally be added to a distillate fuel, they may be formulated as a concentrate using at least one of an organic solvent (e.g., a hydrocarbon solvent, an alcohol solvent, or mixtures thereof) boiling in the range of about 165° C. to about 400° C. or lubricating oil basestock as solvent. Preferably, an aromatic hydrocarbon solvent (such as benzene, toluene, xylene, or higher boiling aromatics or aromatic thinners, and the like) is used. Aliphatic alcohols containing from 3 to 8 carbon atoms (such as isopropanol, isobutylcarbinol, n-butanol, and the like), alone or in combination with hydrocarbon solvents, can also be used. The amount of thiadiazole in the concentrate will ordinarily be at least 10 wt % and, generally, will not exceed about 50 wt % based on solvent. The amount of adduct of benzotriazole or tolyltriazole and basic nitrogen compound will generally be between 30 wt % and 70 wt %. The amount of solvent will make up the balance of the concentrate.

This invention will be further understood by reference to the following examples, which include a preferred embodiment of this invention.

EXAMPLE 1

This example shows a comparison of copper corrosion between a typical metal deactivator and the synergistic combination according to this invention. The corrosion test is ASTM D-130 which is described as follows.

A polished copper strip is immersed in 30 ml of sample contained in a clean, dry 25 by 150 mm test tube and placed into a controlled temperature bath at 100°±1° C. After 3 hours, the copper strip is removed, washed, and compared with the ASTM Copper Strip Corrosion Standards.

The ratings correspond to the following descriptions of the appearance of the copper strip:

| Rating | Description |
|---|---|
| 1a | Slight tarnish. Light orange, almost the same as a freshly polished strip. |
| 1b | Slight tarnish. Dark orange. |
| 2a | Moderate tarnish. Claret red. |
| 2b | Moderate tarnish. Lavender. |
| 2c | Moderate tarnish. Multicolored with lavender blue or silver, or both, overlaid on claret red. |
| 2d | Moderate tarnish. Silvery. |
| 2e | Moderate tarnish. Brassy or gold. |
| 3a | Dark tarnish. Magenta overcast on brassy strip. |
| 3b | Dark tarnish. Multicolored with red and green showing (peacock), but no gray. |
| 4a | Corrosion. Transparent black, dark grey or brown with peacock green barely showing. |
| 4b | Corrosion. Graphite or lusterless black. |
| 4c | Corrosion. Glossy or jet black. |

Various samples of diesel fuels, including sour diesel fuels were treated with Reomet® 39 which is believed to be a 1-(dioctylamino) methyl tolyltriazole manufactured by Ciba-Geigy Corp. and a combination of 30 wt % Elco® 461 which is believed to be a mixture of predominantly dioctyldithio-1,3,4-thiadiazole, with a minor amount of monooctyldithio-1,3,4-thiadiazole manufactured by Elco Corp. and 70 wt % Petrolite® Tolad 9702 which is believed to be a 1:1 adduct of tolyltriazole and bis(2-hydroxyethyl) cocoamine manufactured by Petrolite Corp., and tested for copper corrosion using ASTMD-130. The results are shown in Table 1.

TABLE 1

| | | Copper Corrosion Rating (D-130) | | | |
|---|---|---|---|---|---|
| Additive | Treat rate, mg/L | Diesel 506 | Diesel 506 + 9 mg/L S° | Diesel 434 | Diesel 434 + 9 mg/L S° |
| — | 0 | 3a | 4a | 3b | 4a |
| Reomet 39 | 10 | 3a | 3b | 3b | 3b |
| | 20 | 3a | 3b | 3b | 3b |
| | 30 | 3a | 3b | 3b | 3b |
| | 40 | 3a | 3b | 3b | 3b |
| | 50 | 3a | 3b | 3b | 4a |
| | 80 | 3a | 3b | 3b | 3b |
| Elco 461 | 10 | 3a | 3b | 3b | 3b |
| Tolad 9702 | 20 | | 3b | 3a | 3b |
| | 30 | 1b | 3b | 3a | 4a |
| | 40 | 1b | 1b | 1b | 1b |

This data demonstrates that the combination of Elco® 461 plus Petrolite® Tolad 9702 is capable of achieving a corrosion rating of 1a/1b at the 30 to 40 mg/L treat rate whereas Reomet® 39 cannot even at twice the treat rate.

EXAMPLE 2

This example demonstrates the synergistic action of a thiadiazole plus tolyltriazole adduct versus either component acting alone in different samples of diesel fuels containing corrosive sulfur. Table 2 is a comparison of Petrolite® Tolad 9702 alone, Hitec® 4313 alone, Elco® alone and combinations of Elco® 461, Hitec® 4313 and Petrolite® Tolad 9202 using the copper corrosion test ASTM D-130 described in Example 1. Hitec® 4313 is a mixture of

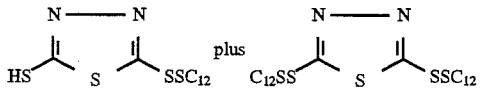

manufactured by Ethyl Corp.

TABLE 2

| Additive | Treat Rate mg/L | Diesel 295 + 9 mg/L S° (1) | Diesel 730 (2) | Diesel 890 (3) | Diesel 890 + 9 mg/L S° (4) |
|---|---|---|---|---|---|
| None | — | 4a | 3b | 3b | 4a |
| Elco 461 | 5 | 4a | | | |
| | 10 | 4a | | | |
| | 15 | 2d | | | |
| | 17 | — | | | |
| | 20 | 1b | | | |
| | 25 | 1b | | | |
| | 26 | | | | |
| | 34 | | | | |
| | 43 | | | | |
| | 52 | | | | |
| Tolad 9702 | 10 | 4a | | | |
| | 20 | 4a | | | |
| | 26 | — | 2c | 2c | |
| | 30 | 4a | | | |
| | 34 | — | | 2c | 2c |
| | 40 | 4a | | | 2b |
| | 43 | | 1a | 1a | 1a |
| | 52 | | 1a | 1a | 1a |
| Hitec 4313 | 9 | | 2e | 4a | 4a |
| | 17 | | 3b | 3b | 3b |
| | 26 | | 3b | 3b | 3b |
| | 34 | | — | — | |
| | 43 | | — | — | |
| | 52 | | 2b | 2e | 3b |
| | 69 | | 2a | 2d | 3b |
| 30 wt % Elco 461* 70 wt % Tolad 9702 | 10** | 4a | | | |
| | 20 | 4a | | | |
| | 30 | 1b | | | |
| | 40 | 1b | | | |
| 23 wt % Elco 461* 77 wt % Tolad 9702 | 17 | | | 3a | 3b |
| | 26 | | | 2e | 3b |
| | 34 | | | 2e | 3b |
| | 43 | | | 1a | 3b |
| | 52 | | | 1a | 1a |
| | 60 | | | 1a | 1a |
| 23 wt % Hitec 4313* 77 wt % Tolad 9702 | 17 | | 2e | 3b | 3b |
| | 26 | | 1a | 2e | |
| | 34 | | 1a | 2e | |
| | 43 | | 1a | 1a | 1a |
| | 60 | | 1a | | 1a |

(1) Diesel fuel contains a total of 15 mg/L S°
(2) Diesel fuel contains 14 mg/L S°
(3) Diesel fuel contains 10 mg/L S°
(4) Diesel fuel contains a total of 19 mg/L S°
*Total amount additive which is a combination of Elco 461 or Hitec 4313 plus Tolad 9702 in the weight ratios specified.
**For example, 10 mg/L treat rates represents 3 mg/L (30 wt %) Elco 461 + 7 mg/L (70 wt %) Tolad 9702

As shown in Table 2, Petrolite® Tolad 9202 in Diesel 295 alone cannot achieve a 1a/1b rating over the treat rate studied. Elco® 461 in Diesel 295 is capable of achieving a 1a/1b rating at a treat rate of 20 mg/L. The combination according to invention shown in Table 2 can achieve a 1a/1b rating at a total 30 mg/L treat rate. This 30 mg/L treat rate is made up of 9 mg/L of Elco® 461 and 21 mg/L of Petrolite® Tolad 9202. Thus, the combination achieves a comparable rating at a treat rate which is less than one-half the treat rate of Elco® 461 alone.

In Diesels 730 and 890, Petrolite® 9702 can achieve a 1a rating at a treat rate of 43 mg/L. Hitec® 4313 cannot achieve a 1a/1b rating over the treat rate studied. In Diesel 730, the synergistic combination can achieve a 1a rating at a total 26 mg/L treat rate. This corresponds to 6 mg/L of Hitec 4313® and 20 mg/L of Petrolite® Tolad 9702. The synergistic combination achieves a 1a rating at a Tolad treat rate of 20 mg/L which is less than one-half the 43 mg/L treat rate required for Tolad alone. Similar synergistic results are demonstrated in Diesel 890 and Diesel 890 spiked with additional sulfur. Benzotriazole adducts exhibit similar synergistic behavior to the tolyltriazole adducts of this Example.

EXAMPLE 3

This example shows that the synergistic combination of the invention produces less insolubles when compared to a single component alone. The test used to determine insolubles is ASTM D-2274 which is described as follows. A 350 ml volume of filtered middle distillate fuel is aged at 95° C. for 16 hours while oxygen is bubbled through the sample at a rate of 3 L/h. After aging, the sample is cooled to approximately room temperature before filtering to obtain the filterable insolubles quantity. Adherent insolubles are then removed from the oxidation cell and associated glassware with trisolvent. The trisolvent is evaporated to obtain the quantity of adherent insolubles. The sum of the filterable and adherent insolubles, expressed as milligrams per 100 ml, is reported as total insolubles.

The results are summarized in Table 3.

TABLE 3

| Properties | Diesel Base | Diesel Base + 100 mg/L Elco 461 | Diesel Base + 30 mg/L Elco 461 + 70 mg/L Tolad 9702 |
|---|---|---|---|
| Filt Insol, mg/100 ml | 0.68 | 1.3 | 0.54 |
| Adh Insol, mg/100 ml | 0.09 | 0.2 | 0.11 |
| Total Insol, mg/100 ml | 0.77 | 1.5 | 0.65 |
| Color Initial | <2.0 | <2.0 | <2.0 |
| Color Final | <2.5 | <3.0 | <3.0 |

As shown in Table 3, the combination of Elco® 461/Petrolite® Tolad 9702 produces less insolubles than Elco® 461 alone at equivalent treat rate.

EXAMPLE 4

An important test for fuel performance in diesel engines is an injector sticking test. This is a qualitative test which evaluates fuel performance in a diesel engine under a given set of engine operating conditions with the only variable being the fuel under evaluation. Each diesel injector is visually inspected for stickiness after each 20 hour cycle of a four cycle test protocol. The combination of 30 wt % Elco® 461/70 wt % Petrolite® Tolad 9702 passed this test at 100 mg/L treat rate whereas Elco® 461 at the same treat rate failed.

EXAMPLE 5

This example demonstrates the synergistic combination of tolyltriazole adduct plus thiadiazole on copper corrosion reduction over different concentrations ranging from tolyltriazole alone to thiadiazole alone. The fuel is Diesel 652 which contains an additional 9 mg/L of free sulfur.

TABLE 4

| Additive Composition | Additive Treat Rate, mg/L Composition Elco 461 | Tolad 9702 | Elco 461 | Tolad 9702 | Cu Corrosion (D-130) |
|---|---|---|---|---|---|
| 100 wt % Tolad 9702 | — | — | — | 34 | 2c |
| | | | | 43 | 1a |
| | | | | 52 | 1a |
| 12 wt % Elco 461 | 4 | 30 | — | — | 2e |
| 88 wt % Tolad 9702 | 5 | 38 | — | — | 2b |
| | 6 | 41 | — | — | 1a |
| 23 wt % Elco 461 | 8 | 26 | — | — | 3a |
| 77 wt % Tolad 9702 | 10 | 33 | — | — | 2c |
| | 12 | 40 | — | — | 1a |
| 34 wt % Elco 461 | 12 | 22 | — | — | 3a |
| 77 wt % Tolad 9702 | 18 | 34 | — | — | 1b |
| | 20 | 40 | — | — | 1b |
| 51 wt % Elco 461 | 17 | 17 | — | — | 1b |
| 49 wt % Tolad 9702 | 22 | 21 | — | — | 1b |
| | 27 | 25 | — | — | 1b |
| 100 wt % Elco 461 | — | — | 20 | — | 2a |
| | — | — | 30 | — | 1b |
| | — | — | 40 | — | 1b |

As shown in Table 4, Tolad 9702 alone requires a treat rate of 43 mg/L to achieve a 1a/1b corrosion rating while Elco® 461 alone requires a treat rate of 30 mg/L to a 1a/1b rating. When Tolad 9702 and Elco® 461 are used in synergistic combination, the combination achieves 1a/1b ratings at lower treat rates over a wide range of concentrations than either Elco® 461 alone or Tolad 9702 alone.

EXAMPLE 6

This example shows that Tolad 9702 alone and Hitec 810 alone are not as effective as a 2,5-dihydrocarbyldithiol,3,4-thiadiazole, e.g., Elco 461 or present additive combination of this invention, Elco 461+Tolad 9702, in reducing silver corrosion of a fuel. The distillate fuel is a motor gasoline containing 36 mg/L elemental sulfur. Silver corrosion ratings were measured according to standardized test IP 227

The results are shown in Table 5.

TABLE 5

| Additive Composition | Treat Rate (mg/L) | Silver Corrosion Rating |
|---|---|---|
| None | 0 | 4 |
| 100 wt % Hitec 810* | 100 | 4 |
| | 200 | 3 |
| | 600 | 2 |
| 100 wt % Tolad 9702 | 1000 | 1 |
| 100 wt % Elco 461 | 100 | 0 |
| 22.7 wt % Elco 461 | 45 | 0 |
| 77.3 wt % Tolad 9702 | 135 | |
| 22.7 wt % Elco 461 | 91 | 0 |
| 77.3 wt % Tolad 9702 | 398 | |

*Hitec 810 is a commercially available corrosion inhibitor composition containing barium sulfonate sold by Ethyl

EXAMPLE 7

This example demonstrates that the combination additive of Elco 461 and Tolad 9702 gave no failure of the snowmobile two-cycle engine whereas each additive alone lead to failure of the engine. The following test was used.

Test Description

The engine test employed an oval-shaped tank which was filled to about ½ full with water. A 700 cc snowmobile chassis was floated on the water and mounted to the tank. This entire rig test was housed in a 25'×40" building with a large overhead door to let in fresh air. A 4' diameter fan was used also to push air through the building. A radiator cooling system with a fan was used to keep the engine at normal operating temperature. Also, a pneumatic, cyclic system was used to operate the throttle control. The engine was run for ten seconds at a wide-open throttle position and then for ten seconds at a idle position. The engine was operated for up to 8 hours a day, barring any mechanical breakdowns. The fuel was distributed to the engine by fuel lines that came in from outboard fuel tanks. Normally, a 200 L fuel tank (drum) was used during this fuel testing, two separate fuel tanks were used. The separation of the fuels was made by either a duel fuel pump system (carb model) or a slip fuel rail on a fuel injection system. The latter was used in the fuel testing. The results are shown in Table 6.

TABLE 6

| FUEL | ELEMENTAL SULPHUR, mg/L | ADDITIVE | TREAT RATE mg/L | ENGINE TEST HOURS TO FAILURE | COMMENTS |
|---|---|---|---|---|---|
| A | 30–40 | None | 0 | 13 | |
| B | 30–40 | None | 0 | 12.5 | |
| US Fuel | 0 | None | 0 | 100+ | (no failure) |
| C | 30–40 | None | 0 | 36 | (1) |
| F | 25 | Tolad 9702 | 2000 | 42 | |
| H | 25 | Elco 461 | 200 | 100+ | no failure |
| | | Tolad 9702 | 800 | | |
| E | 25 | Elco 461 | 200 | 51 | estimated based on test procedure |

(1) Run on gasoline with elemental sulphur for 3.2 hours, pulled cylinders, black color then ran on U.S. fuel (no elemental sulphur) for 36 hours before bearings failed.

0=no tarnish

1=slight tarnish

2=moderate tarnish

3=slight blackening

4=blackening

What is claimed is:

1. A distillate fuel composition for two-cycle engines having improved silver corrosion properties which comprises a major amount of distillate fuel boiling in the motor gasoline range and containing corrosive sulfur, a minor amount of lubricating oil base-stock and a synergistic additive combination of (a) from 5 to 400 mg/L of at least one 2,5-dihydrocarbyldithio-1,3,4-thiadiazole of the formula

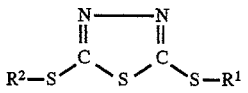

wherein $R^1$ and $R^2$ are independently $R^3S$ or H where $R^3$ is a hydrocarbyl group containing from 1 to 16 carbon atoms with the proviso that at least one of $R^1$ and $R^2$ is not hydrogen, and (b) from 20 to 1500 mg/L of an adduct of benzotriazole or tolyltriazole and an alkoxyamine.

2. The composition of claim 1 wherein $R^3$ is a hydrocarbyl group of from 1 to 12 carbon atoms.

3. The composition of claim 1 wherein the adduct is tolyltriazole with an alkoxy fatty amine.

4. The composition of claim 3 wherein the alkoxy fatty amine has the formula $R^4R^5NR^6$ where $R^4$ and $R^5$ are $C_1$ to $C_4$ hydrocarbyl groups substituted with hydroxy and $R^6$ is a hydrocarbyl group of from $C_8$ to $C_{20}$ carbon atoms.

5. The composition of claim 4 wherein $R^4$ and $R^5$ are hydroxyethyl groups.

6. The composition of claim 3 wherein the tolyltriazole adduct is a 1:1 adduct of tolyltriazole with bis(2-hydroxyethyl) oleylamine or with bis(2-hydroxyethyl) cocoamine.

7. A method for reducing silver corrosion in a two-cycle internal combustion engine which comprises operating the two-cycle internal combustion engine with a fuel composition containing an effective amount to reduce silver corrosion of the synergistic combination of claim 1.

8. An additive concentrate suitable for blending with a distillate fuel to provide silver corrosion protection in two-cycle engines which comprises a solvent and from 10 wt % to 50 wt % based on solvent of at least one 2,5-dihydrocarbyldithio-1,3,4-thiadiazole of the formula

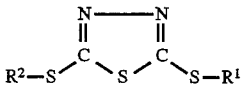

wherein $R^1$ and $R^2$ are independently $R^3S$ or H where $R^3$ is a hydrocarbyl group containing from 1 to 16 carbon atoms with the proviso that at least one of $R^1$ and $R^2$ is not hydrogen, and from 30 wt % to 70 wt % based on solvent of an adduct of benzotriazole or tolyltriazole and an alkoxyamine.

9. The concentrate of claim 8 wherein the solvent is an organic solvent, lubricating oil basestock or mixture thereof.

* * * * *